United States Patent [19]

Royer

[11] 3,977,610

[45] Aug. 31, 1976

[54] OSCILLATING SPRINKLER

[75] Inventor: John A. Royer, Fresno, Calif.

[73] Assignee: James R. Coson, Fresno, Calif.

[22] Filed: Dec. 22, 1975

[21] Appl. No.: 643,193

[52] U.S. Cl. ..... 239/230; 239/233

[51] Int. Cl.[2] ..... B05B 3/04

[58] Field of Search ..... 239/230, 231–233

[56] References Cited

UNITED STATES PATENTS

| | | | |
|---|---|---|---|
| 2,256,737 | 9/1941 | Englehart | 239/230 |
| 2,710,226 | 6/1955 | Izchaki | 239/231 |
| 3,022,012 | 2/1962 | Sharp et al. | 239/230 |
| 3,408,009 | 10/1968 | Friedman et al. | 239/230 |
| 3,434,665 | 3/1969 | Royer | 239/230 |
| 3,581,994 | 6/1971 | Heiberger | 239/233 X |
| 3,726,479 | 4/1973 | Leissner et al. | 239/233 |
| 3,918,643 | 11/1975 | Malcolm | 239/230 |
| 3,930,617 | 1/1976 | Dunmire | 239/230 |

FOREIGN PATENTS OR APPLICATIONS

| | | | |
|---|---|---|---|
| 208,753 | 6/1957 | Australia | 239/230 |
| 588,459 | 2/1959 | Italy | 239/233 |

*Primary Examiner*—Robert S. Ward, Jr.
*Attorney, Agent, or Firm*—Huebner & Worrel

[57] ABSTRACT

An oscillating sprinkler having improved provision for confining fluid discharge to a predetermined arc through which the sprinkler reciprocates, including a nozzle adapted to direct a stream along an axis in predetermined relation thereto, a pair of cooperative concave vanes; and means mounting the vanes in fixed spaced relation for integral movement to and from the stream with their concavities disposed toward a predetermined fluid path therebetween, one of the vanes being adjacent to the nozzle and having an inner end disposed theretoward in acute angular relation to the axis when in the stream and an opposite end curved laterally from the axis, the other vane being spaced laterally and longitudinally of the axis from said one vane in the direction of curvature thereof having an inner end substantially parallel to said opposite end of said one vane and an opposite end substantially parallel to the inner end of said one vane.

6 Claims, 5 Drawing Figures

OSCILLATING SPRINKLER

BACKGROUND OF THE INVENTION

The present invention relates to an oscillating sprinkler and more particularly to such a sprinkler that dependably confines its discharge to a predetermined arcuate sector of fluid distribution.

The prior art can be typified by reference to U.S. Pat. Nos. 2,792,256; No. 3,022,012; and No. 3,408,009.

It is well known to drive rotary and oscillating sprinklers by means of an impact lever which periodically strikes an anvil or stop under the alternate and opposing forces of the impingement thereagainst of a discharge stream of the sprinkler and an energy storing spring. Where fluid distribution over less than a full circle is desired, it is also well known to oscillate such sprinklers through a predetermined arc. In such sprinklers, the impact lever pivots to and from a main discharge stream and by such action disperses the stream into unintended areas of distribution. In irrigation systems, this wastes water, interferes with automotive and pedestrian traffic, water marks windows, wets buildings, and otherwise has harmful and deleterious effects which have long been recognized in the trade and extensive efforts made to ameliorate. While progress has been made in minimizing uncontrolled water distribution by such sprinklers, prior to the present invention, they have still been characterized by inadvertent, uncontrolled, back or side splash, sometimes referred to as "overspray".

SUMMARY OF THE INVENTION

An object of the present invention is therefore to provide an improved oscillating sprinkler minimizing the misdirection of fluid thereby.

Another object is to provide improved means for driving the impact levers of such sprinklers by the impingement of fluid thereagainst in which dispersal of the fluid is limited virtually exclusively to predetermined desired areas.

A further object is to provide improved cooperative fluid impact vanes for the impact levers of oscillating sprinklers.

Still further objects and advantages of the present invention are to provide improved elements and arrangements thereof in a sprinkler which is precise in its confinement of discharged fluid to predetermined sectors.

DESCRIPTION OF THE PREFERRED EMBODIMENT

Figure 1:
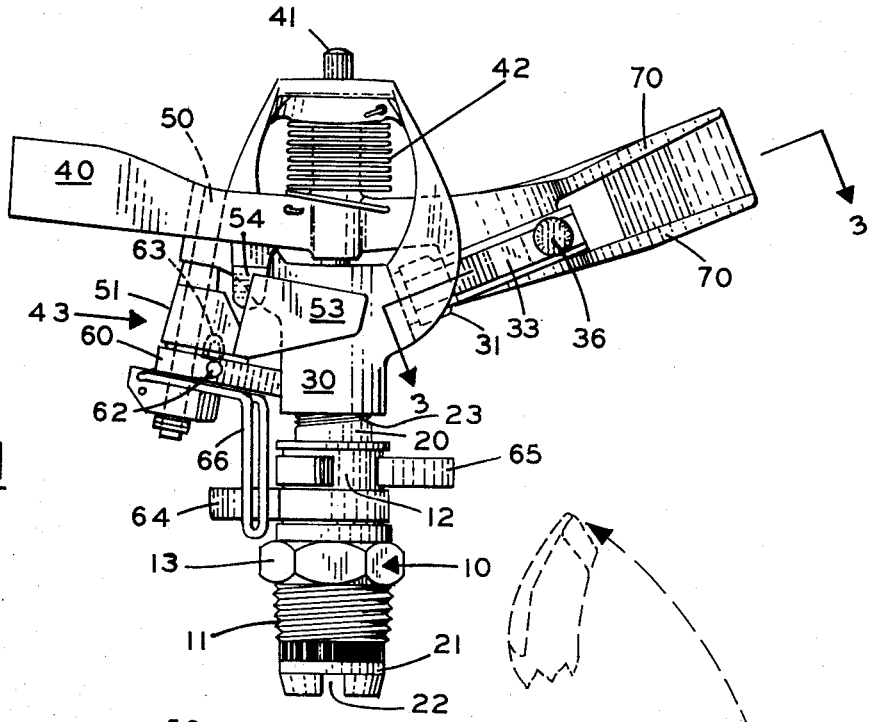
FIG. 1 is a side elevation of a sprinkler embodying the principles of the present invention.

While the essence of the present invention resides in the provision of improved fluid directing vanes in a particular relationship on an impact lever of a sprinkler, their description is deferred for better understanding after a description of a typical operational environment which is essentially conventional but conducive to an understanding of the invention.

Referring in greater detail to the drawing, the sprinkler provides a bearing 10 having an internal bore, not shown, a male screw-threaded mounting end 11 and an opposite cylindrical end 12. A wrench head 13 is provided adjacent to the mounting end.

A tubular sprinkler 20 is rotatably mounted in the bore of the bearing 10, has an enlarged head 21 providing a diametric tool slot 22 and an opposite screw-threaded end 23. An antifriction sealing washer is provided between the head 21 and the mounting end 11 of the bearing.

A body 30 is screw-threadably mounted on said opposite end 23 of the spindle 20. The body mounts a nozzle 31 which has a predetermined laterally and normally upwardly directed discharge axis 32 and is in fluid communication with the tubular spindle 20 through the body. Integral with the nozzle is an arm 33 extended along side of the axis and providing a primary anvil or stop 34 disposed toward the axis. A dispersing screw 35 is mounted on the arm for adjustable positioning toward and from the axis. As is well known, the screw provides a head 36 and a spring 37 is mounted under compression between the head and the arm to resist inadvertent maladjustment of the screw. For purposes of convenient reference, the stream emitted from the nozzle 31 is indicated at 38 in FIGS. 3 through 5.

Figure 2:
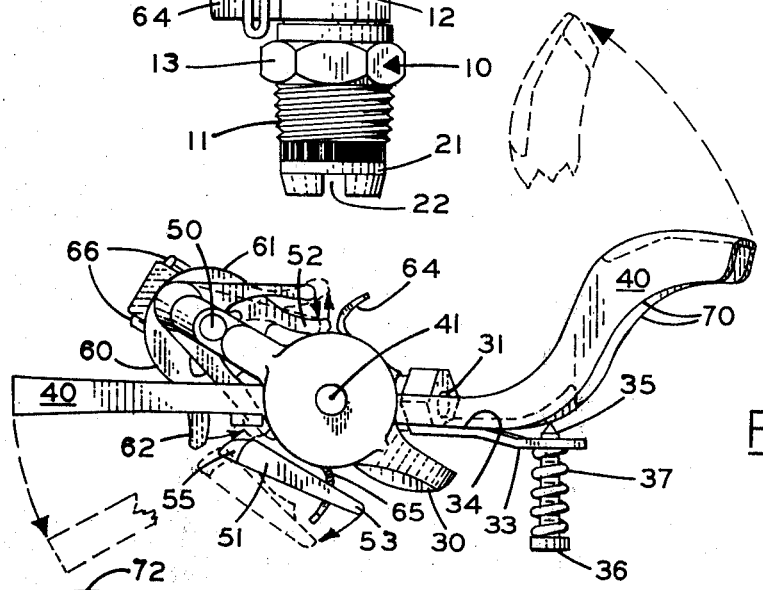
FIG. 2 is a top plan view of the sprinkler fragmentarily illustrating an alternate position of an impact lever in dashed lines.

A weighted impact lever 40 is mounted for reciprocal pivotal movement about a pivot pin 41 on the body 30 coaxially with the spindle 20. A helical spring 42 is mounted about the pin and interconnects the impact lever 40 and the body 30 resiliently to urge the impact lever against the primary anvil 34. As will subsequently become apparent, when fluid is emitted from the nozzle 31 it strikes the impact lever, drives the lever away from the stream in opposition to the spring 42, and is subsequently returned to the stream by energy stored in the spring. This results in periodic impacting of the lever 40 against the primary anvil to rotate the sprinkler in increments of stepped progression in a clockwise direction, as viewed in FIG. 2. However, when the sprinkler has rotated to a desired limit in the clockwise direction, it is desirable to reverse the sprinkler and cause it to rotate in a counterclockwise direction, as viewed in FIG. 2, until it reaches a predetermined limit in that direction of rotation. To achieve this, a well-known form of control system indicated generally at 43 is utilized.

Referring in greater detail to the control system 43, a shaft 50 is mounted on the body 30 in spaced relation to the pin 41. A bifurcated limit arm 51 is mounted on the shaft 50 and has one leg 52 disposed on one side of the body and a second leg 53 disposed on the opposite side of the body. A hammer 54 is downwardly extended from the impact lever 40 and is a unitary part thereof. The limit arm has two positions between which it may be pivoted. When it is pivoted in a counterclockwise direction, as viewed in FIG. 2, the second leg 53 engages the body and is disposed in the path of the hammer 54 limiting pivotal movement of the impact lever 40 to a restricted range of pivotal movement. When the limit arm 51 is pivoted in the opposite direction, the first leg 52 engages the body 30 and limits the clockwise movement of the limit arm to a position with the hammer 54 retracted outwardly from the path of the movement of the hammer 54 so as no longer to limit the pivotal movement of the impact lever 40. When the second leg 53 is disposed in the path of the hammer 54, the hammer impacts thereagainst and thus the second leg is provided with a secondary anvil 55 to receive the blows of the hammer.

A bifurcated control yoke 60 is pivotally mounted on the shaft 50 and has legs 61 and 62 extended on opposite sides of the body which limit the maximum pivotal movement of the yoke on the shaft. An over-center spring 63 interconnects the control yoke and the limit arm so that when the leg 61 of the yoke is against the body 30, the limit arm 51 is pivoted so that the leg 53 engages the body and the secondary anvil 55 is within the path of the hammer 54. Conversely, when the leg 62 of the control yoke 60 is against the body 30, the limit arm 51 is pivoted in a clockwise direction as far as the leg 52 permits retracting the secondary anvil 55 from the path of the hammer. A pair of stops 64 and 65 are frictionally mounted on the cylindrical end 12 of the bearing 10 or adjustable rotational positioning. A control finger 66 is mounted on the control yoke 60 and downwardly extended between the stops 64 and 65. Thus, when the leg 62 of the control yoke 60 is against the body 30, the secondary anvil 55 is out of the path of the hammer 54 and the impact lever is free to reciprocate through a major are periodically to impact the primary anvil 34 and drive the sprinkler in a clockwise direction, as viewed in FIG. 2. When such travel progresses to the point that the control finger hits the stop 64, the control yoke 60 is pivoted to bring the leg 61 into engagement with the body and thus to pivot the limit arm 51 through the action of the spring 63 into a position with the secondary anvil 55 disposed in the path of the hammer 54. In such condition, the hammer impacts the secondary anvil and restricts the impact lever 40 to a very narrow range of pivotal movement and the successive impacts drive the sprinkler in a counterclockwise direction, as viewed. When the control finger 66 reaches the stop 65, the control yoke is pivoted in its counterclockwise direction to retract the secondary anvil 55 from the path of the hammer 54 and the impact lever 40 is thus relieved from restriction as to pivotal movement and successively impacts the primary anvil 34 to drive the sprinkler in a clockwise direction, as before.

Figure 3:
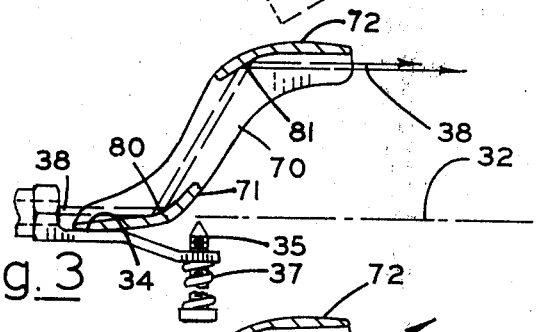
FIG. 3 is a fragmentary section taken on line 3-3 of FIG. 1 showing a portion of the impact lever against an anvil therefor and illustrating a resultant deflected and redeflected fluid stream.
Figure 4:
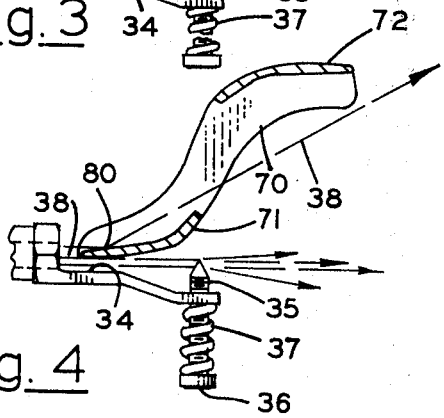
FIG. 4 is a fragmentary section similar to that of FIG. 3 but showing the impact lever slightly withdrawn from its anvil with a resultant once deflected fluid stream.
Figure 5:
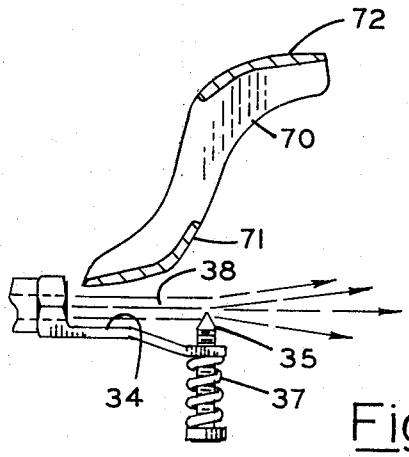
FIG. 5 is a fragmentary section similar to FIG. 3 but showing the impact lever withdrawn from the discharge stream.

The structure described to this point constitutes operational environment for the improvement of the present invention and is well known in the art. However, the impact lever 40 is of specialized construction to avoid undesirable dispersion of fluid emitted from the nozzle 31 into areas outside the desired areas of liquid distribution as delineated by the adjustable positioning of the stop 64 and 65. The impact lever 40 is of unitary construction and outwardly of the nozzle 31 provides upper and lower substantially parallel flanges between which are mounted an inner arcuate vane 71 and an outer arcuate vane 72 which are integral parts of the impact lever 40. As best shown in FIGS. 3, 4 and 5, the inner vane 71 has an inner edge which is acutely angularly related to the axis 32 of the nozzle 31 when the impact lever is engaged with the primary anvil 34, as shown in FIG. 3. The inner vane extends arcuately away from the nozzle in progressively more obtusely angular relation to the axis. The vanes have arcuate concave surfaces disposed on opposite sides of a predetermined path of fluid projection therebetween. The outer vane is spaced from the inner vane longitudinally of the axis 32 and transversely therefrom. The outer vane has an inner edge which is substantially parallel to the outer edge of the inner vane 71 and an outer edge which is substantially parallel to the inner edge of the inner vane 71 and thus is acutely angularly related to the axis 32.

As best shown in FIG. 3, when the impact lever 40 is against the primary anvil 34, fluid emitted from the nozzle 31 strikes the inner vane 71 at a position 80 at which the vane is more obtusely angularly related to the axis 32 than the vane is at its inner edge and thus the stream is deflected to strike the outer vane 72 at a position 81 which is in spaced relation to the outer edge of the outer vane and thus more obtusely angularly related to the axis than the outer edge. The angularity of the vanes at the impinging points 80 and 81 are such that the fluid stream is then deflected from the outer vane into substantially parallel relation to the axis 32 and thus the fluid is accurately confined to the area of desired coverage. As the fluid stream impinges on the outer vane 72, the impact lever 40 is pivoted in a counterclockwise direction at the initial stage of which the impact lever moves from the primary anvil 34, as best shown in FIG. 4. In such configurations, a portion of the stream discharged by the nozzle 31 is projected along the axis 32 while a portion of the stream strikes the inner vane 71 adjacent to the inner edge thereof. It will be observed that as the vane 71 moves from the primary anvil 34, the stream impinges on the inner vane at a point progressively closer to the inner edge and thus progressively more acutely angularly related to the axis. This results in progressively less deflection of the stream so that it impinges closer and closer to the outer edge of the outer vane which is more acutely angularly related to the axis and thus the second deflection is correspondingly more acutely angularly related to the axis to release the stream in substantially parallel relation to the axis. By the time the impact lever 40 has moved to the position of FIG. 4, the deflection of the stream by the inner vane 71 has become so acute that it misses the outer edge of the outer vane 72 and is projected directly into the desired area of distribution. As shown in FIG. 5, when the impact lever 40 has pivoted far enough to remove the inner vane 71 from the stream, the stream is projected on a trajectory along the axis 32.

It will be observed that when the stream impinges on the inner vane 71 at the position 80 as shown in FIG. 3, the reaction is to urge the inner vane against the primary anvil 34 but when the stream impinges on the secondary or outer vane 72 at position 81, the reaction is in the opposite direction through a greater lever arm and such impingement at 81 forces the lever in a counterclockwise direction from the primary anvil 34. When the position of first impact 80 on the inner vane 71 has moved to the position shown in FIG. 4 adjacent to the inner edge of the vane, the resistance to counterclockwise rotation is slight because of acute angularity of the vane at the position of impact and since the stream misses the outer vane 72, there is no longer a driving force applied to the lever through the outer vane. When the impact lever reaches the position of FIG. 5, it continues to pivot in a counterclockwise direction until its inertia is spent in energy stored in the spring 42 which eventually returns the impact lever in a counterclockwise direction. As the impact lever 40 returns toward the primary anvil 34, the inner edge of the inner vane 71 first enters the stream, as shown in FIG. 4. A portion of the stream is thus deflected, urging the lever toward the primary anvil, and missing the outer vane 72. As the impact lever moves against the primary anvil 34, the stream strikes a more obtuse angularly related portion of the inner vane 71, is more obtusely deflected to strike a correspondingly obtuse portion of the outer vane 72 resulting in a twice deflected stream which is substantially parallel to the axis 32.

Thus, when the stops 64 and 65 are positioned to delineate an arc to be sprinkled, all fluid thereafter striking a vane 71 or vanes 71 and 72 is deflected into the area so delineated. "Back splash", "side splash" and "overspray" which have long plagued oscillating sprinklers are substantially eliminated.

Although the invention has been herein shown and described in what is conceived to be the most practical and preferred embodiment, it is recognized that departures may be made therefrom within the scope of the invention.

Having described my invention, what I claim as new and desire to secure by Letters Patent is:

1. In a sprinkler having a nozzle adapted to direct a stream along an axis in predetermined relation thereto, a pair of cooperative concave vanes; and means mounting the vanes in fixed spaced relation for integral movement to and from the stream with their concavities disposed toward a predetermined fluid path therebetween, one of the vanes being adjacent to the nozzle and having an inner end disposed theretoward in acute angular relation to the axis when in the stream and an opposite end curved laterally from the axis, the other vane in its entirety being spaced laterally and longitudinally of the axis from said one vane in the direction of curvature thereof so that the vanes overlap neither laterally nor longitudinally of the axis, and said other vane having an inner end substantially parallel to said opposite end of said one vane and an opposite end substantially parallel to the inner end of said one vane.

2. The combination of claim 1 in which the vanes are shaped and arranged so that when said one vane is in the stream to its maximum point of movement theretoward the one vane deflects the stream from the axis sufficiently to strike the other vane whereby it is deflected a second time to substantially parallel relation to the axis, so that as the one vane moves in the opposite direction the one vane progressively deflects the stream to a lesser extent until it misses the outer end of said other vane, so that as said one vane continues its movement in said opposite direction it moves from the stream, so that as said one vane returns to the stream it first deflects the stream insufficiently to strike the other vane, and so that as said one vane continues into the stream it progressively deflects the stream to a greater extent until it strikes the other vane whereupon it is deflected thereby to a path substantially parallel to the axis.

3. In a sprinkler having a nozzle adapted to direct a fluid stream along a predetermined axis; first and second cooperative stream deflecting vanes; means pivotally mounting the vanes in unitary spaced relation for reciprocal movement toward and from the stream; and a stop engageable with the first vane when the first vane is in the stream to limit movement of the vanes in the direction toward the stream, the first vane having a first end acutely angularly related to the axis when the first vane is against the stop and an opposite end more obtusely angularly related to the axis whereby the first vane angularly deflects the stream a maximum when it is against the stop and the stream impinges against a relatively obtuse portion of the vane and deflects the stream substantially less as the vane moves from the stop and the stream impinges against the first vane at positions progressively closer to its first end, and the second vane has a first end substantially parallel to said opposite end of the first vane and an opposite end which is substantially parallel to first end of the first vane, the second vane being spaced longitudinally and transversely of the axis from the first vane in a position for the impingement of the stream deflected by the first vane thereagainst at a position in spaced relation to said opposite end when the first vane is against the stop and as the first vane moves from the stop the position of impingement on the second vane moves toward said opposite end until the deflected stream misses the second vane substantially entirely before the first vane moves from the stream.

4. In a sprinkler having a nozzle adapted to discharge a stream along an axis in a predetermined direction therefrom, an oscillating element, and means mounting the element for reciprocal pivotal movement transversely of the stream; an arcuate first vane rigidly mounted on the element for pivotal movement therewith between a first position in the stream and a second position retracted from the stream, said vane in its first position having an end portion adjacent to the nozzle and an opposite end portion, said end portion adjacent to the nozzle being in acute angular relation to said axis and extending toward the opposite end portion across the stream in arcuate progressively more obtusely angular relation to said axis whereby the stream strikes the first vane when it is in its first position and is angularly deflected from said axis away from the nozzle and as the vane moves from its first position the stream is deflected from said axis progressively to a lesser extent until the vane leaves the stream; and an arcuate second vane rigidly mounted on said element in spaced relation to the first vane having an arcuate surface disposed to receive the stream deflected from the first vane when the first vane is in its first position to deflect the stream a second time back to substantially parallel relation to the axis of the nozzle, having an arcuate surface continuing outwardly from the first vane of progressively more acute angular relation to said axis so that as the first vane pivots from its first position the stream deflected thereby impinges on the progressively more acutely angularly related portions of the second vane to return the stream to substantially parallel relation with the axis and having an outer end portion that moves out of the deflected stream before the first vane moves out of the stream.

5. In an oscillating sprinkler having a body, means adapted to mount the body in fluid communication with a source of fluid under pressure and for oscillation about a substantially erect axis, a nozzle mounted on the body adapted to direct a fluid stream along an axis outwardly from the axis of body oscillation, a primary anvil mounted on the body adjacent to the nozzle, an impact lever mounted on the body for reciprocal pivotal movement about a substantially erect axis toward and from the primary anvil to rotate the body in increments of stepped progression in one direction, resilient means urging the impact lever toward the primary anvil, a secondary anvil mounted on the body at the side of the axis thereof opposite to the primary anvil for movement to and from the path of the impact lever engageable with said lever when in its path to rotate the body in increments of stepped progression opposite to said one direction, and control means for moving said secondary anvil to and from said path of the impact lever whereby the body oscillates to move the nozzle back and forth through a predetermined arc; reaction means on said impact lever movable to and from said stream to reciprocate the impact lever while substantially confining the distribution of the fluid over said predetermined arc comprising:

A. a first vane integral with the lever disposed for movement through the stream to impact the primary anvil at an edge of the stream and back through the stream to a position retracted from the stream; and B. a second vane integral with the lever spaced from the first vane longitudinally of the stream and transversely of the stream in the direction of retraction of the lever, 1. each of said vanes having an inner edge disposed toward the nozzle, an outer edge disposed away from said nozzle, and a concave central portion disposed toward the stream, 2. the central portion of the first vane being disposed in the stream when the first vane is in impact position and angularly related thereto to deflect the stream between the vanes and against the central portion of the second vane, said second vane being concave and angularly disposed to the deflected stream to deflect the stream a second time to substantial parallel relation to said nozzle axis, 3. the first vane being progressively more acutely angularly related to the stream as it nears its inner edge so that as the first vane moves to impact position the stream impinges on progressively more acutely angularly related portions thereof to be more acutely deflected toward the second vane to impinge thereon at positions progressively closer to the outer edge thereof, said second vane being progressively more acutely angularly related to the axis of the stream as it nears its outer edge so that as the stream is more acutely deflected from the first vane it is correspondingly more acutely angularly deflected in the opposite direction by the second vane to return to substantial parallelism with the axis of the nozzle, the inner edge of the first vane being sufficiently acutely angularly related to the stream that before it moves from the stream it deflects the stream so slightly as substantially to miss the outer edge of the second vane.

6. The combination of claim 5 in which as the impact lever approaches the primary anvil the stream first impinges against the acutely angularly related inner edge of the first vane to drive the lever toward the primary anvil while the stream is deflected insufficiently to impinge against the second vane so as to avoid resistance therefrom and as the impact lever continues toward the primary anvil the stream strikes progressively more obtuse portions of the first vane to receive increased thrust therefrom toward the primary anvil as the stream is deflected sufficiently to strike the second vane and be redeflected thereby to substantially parallel relation to the axis of the nozzle and to oppose the thrust toward the primary anvil.

* * * * *

UNITED STATES PATENT AND TRADEMARK OFFICE

CERTIFICATE OF CORRECTION

PATENT NO. : 3,977,610

DATED : August 31, 1976

INVENTOR(S) : John A. Royer

It is certified that error appears in the above-identified patent and that said Letters Patent are hereby corrected as shown below:

Column 2, Line 39,

After the word "helical" and before the word "spring", insert --- torsion ---.

Column 3, Line 6,

After the word "of", delete the word "the".

Column 3, Line 33,

Delete the word "are" and insert --- arc ---.

Signed and Sealed this

Seventh Day of December 1976

[SEAL]

*Attest:*

RUTH C. MASON
*Attesting Officer*

C. MARSHALL DANN
*Commissioner of Patents and Trademarks*